US007171309B2

(12) United States Patent
Goodman

(10) Patent No.: US 7,171,309 B2
(45) Date of Patent: Jan. 30, 2007

(54) DOWNHOLE TOOL CONTROLLER USING AUTOCORRELATION OF COMMAND SEQUENCES

(75) Inventor: Kenneth R. Goodman, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 108 days.

(21) Appl. No.: 10/692,775

(22) Filed: Oct. 24, 2003

(65) Prior Publication Data

US 2005/0090985 A1 Apr. 28, 2005

(51) Int. Cl.
*G01V 1/00* (2006.01)
*G06F 19/00* (2006.01)

(52) U.S. Cl. ..... 702/6; 166/250.1

(58) Field of Classification Search ..... 702/1–14; 367/83, 197; 340/854.3; 175/45, 9; 73/152.02; 701/14; 202/14; 166/270.1, 250.01, 250.1; 248/205.5
See application file for complete search history.

(56) References Cited

U.S. PATENT DOCUMENTS

| | | | | | |
|---|---|---|---|---|---|
| 3,914,732 | A * | 10/1975 | Brumleve et al. | ..... | 367/197 |
| 4,051,901 | A * | 10/1977 | Sarem et al. | ..... | 166/270.1 |
| 4,147,222 | A * | 4/1979 | Patten et al. | ..... | 175/9 |
| 4,166,979 | A * | 9/1979 | Waggener | ..... | 375/376 |
| 4,231,112 | A * | 10/1980 | Massa | ..... | 367/158 |
| 4,282,588 | A * | 8/1981 | Chanson et al. | ..... | 367/82 |
| 4,297,879 | A * | 11/1981 | Howells et al. | ..... | 73/152.02 |
| 4,346,593 | A * | 8/1982 | Howells et al. | ..... | 73/152.02 |
| 4,554,975 | A * | 11/1985 | Vann et al. | ..... | 166/297 |
| 4,782,910 | A * | 11/1988 | Sims | ..... | 181/106 |
| 4,839,644 | A * | 6/1989 | Safinya et al. | ..... | 340/854.3 |
| 4,866,680 | A * | 9/1989 | Scherbatskoy | ..... | 367/83 |
| 4,951,907 | A * | 8/1990 | Gold | ..... | 248/205.5 |
| 4,971,160 | A * | 11/1990 | Upchurch | ..... | 175/4.54 |
| 5,050,675 | A * | 9/1991 | Upchurch | ..... | 166/373 |
| 5,113,379 | A * | 5/1992 | Scherbatskoy | ..... | 367/83 |
| 5,150,333 | A * | 9/1992 | Scherbatskoy | ..... | 367/83 |
| 5,182,730 | A * | 1/1993 | Scherbatskoy | ..... | 367/83 |
| 5,592,438 | A * | 1/1997 | Rorden et al. | ..... | 367/83 |
| 5,963,138 | A * | 10/1999 | Gruenhagen | ..... | 340/679 |
| 6,308,137 | B1 * | 10/2001 | Underhill et al. | ..... | 702/9 |
| 6,584,406 | B1 * | 6/2003 | Harmon et al. | ..... | 702/6 |
| 6,626,253 | B2 * | 9/2003 | Hahn et al. | ..... | 175/48 |
| 6,885,918 | B2 * | 4/2005 | Harmon et al. | ..... | 701/14 |
| 2004/0006430 | A1 * | 1/2004 | Harmon et al. | ..... | 702/14 |

(Continued)

FOREIGN PATENT DOCUMENTS

| | | |
|---|---|---|
| GB | 971109 | 9/1964 |

(Continued)

*Primary Examiner*—Michael Nghiem
*Assistant Examiner*—Victor J. Taylor
(74) *Attorney, Agent, or Firm*—Trop, Pruner & Hu, P.C.; Bryan P. Galloway; Jaime A. Castano

(57) ABSTRACT

The present invention provides for an apparatus and method of use to control a downhole tool remotely based on the autocorrelation of command sequences. Repeating signals of a priori unknown or undefined shape can be correlated to themselves to reliably distinguish intentional changes from random fluctuations or other operations performed on the well. Using autocorrelation, any fluctuation of pressure of sufficient amplitude can be used to send commands by controlling the timing or the number of repetitions of the sequence.

27 Claims, 3 Drawing Sheets

U.S. PATENT DOCUMENTS

2005/0090985 A1* 4/2005 Goodman ..... 702/6

FOREIGN PATENT DOCUMENTS

GB 2288834 A * 11/1995
GB 2 373 804 10/2002
WO 0552833 A1 * 7/1993
WO WO 97/14869 * 4/1997

* cited by examiner

DOWNHOLE TOOL CONTROLLER USING AUTOCORRELATION OF COMMAND SEQUENCES

BACKGROUND

1. Field of Invention

The present invention pertains to controllers of downhole tools used in subsurface well completions, and particularly to remotely actuated controllers.

2. Related Art

It is often desired to control downhole tools and equipment from the surface without using a dedicated communication medium, such as a wire, tube, or fiber optic cable. Whenever an existing medium such as drill pipe or wellbore fluids can be used, operating a downhole tool or device can be simplified and cost reduced.

Some prior art controllers that use such an existing medium use a set of predefined pressure sequences or expected pressure profiles programmed into a processor or other memory device to identify an actuation command sent from a remote location. The controller monitors pressure variations in the medium. Such variations may be monitored continuously or sampled discreetly. By comparing the received waveform with the reference pressure pulses, the controller is able to discriminate between noise and a command signal. When a command signal is detected, the controller responds by actuating a downhole device.

In wells with open perforations, it is sometimes difficult to send signals to a controller that uses predefined pressure sequences as a reference. To produce a response from the controller, the controller must receive pressure signals that match those pre-programmed pressure sequences within certain ranges of amplitudes and with changes at appropriate rates. Open perforations make it difficult or impossible to transmit and receive such sequences due to the wide variations in formation pressure, porosity, well fluids, and permeabilities normally encountered in a well.

SUMMARY

The present invention provides for an apparatus and method to control a downhole tool remotely based on the autocorrelation of command sequences. Repeating signals of a priori unknown or undefined shape can be correlated to themselves to reliably distinguish intentional changes from random fluctuations or other operations performed on the well. Using autocorrelation, any variation of sufficient magnitude can be used to send commands by controlling, for example, the timing or number of repetitions in a sequence.

Advantages and other features of the invention will become apparent from the following description, drawings, and claims.

DETAILED DESCRIPTION

Figure 1:
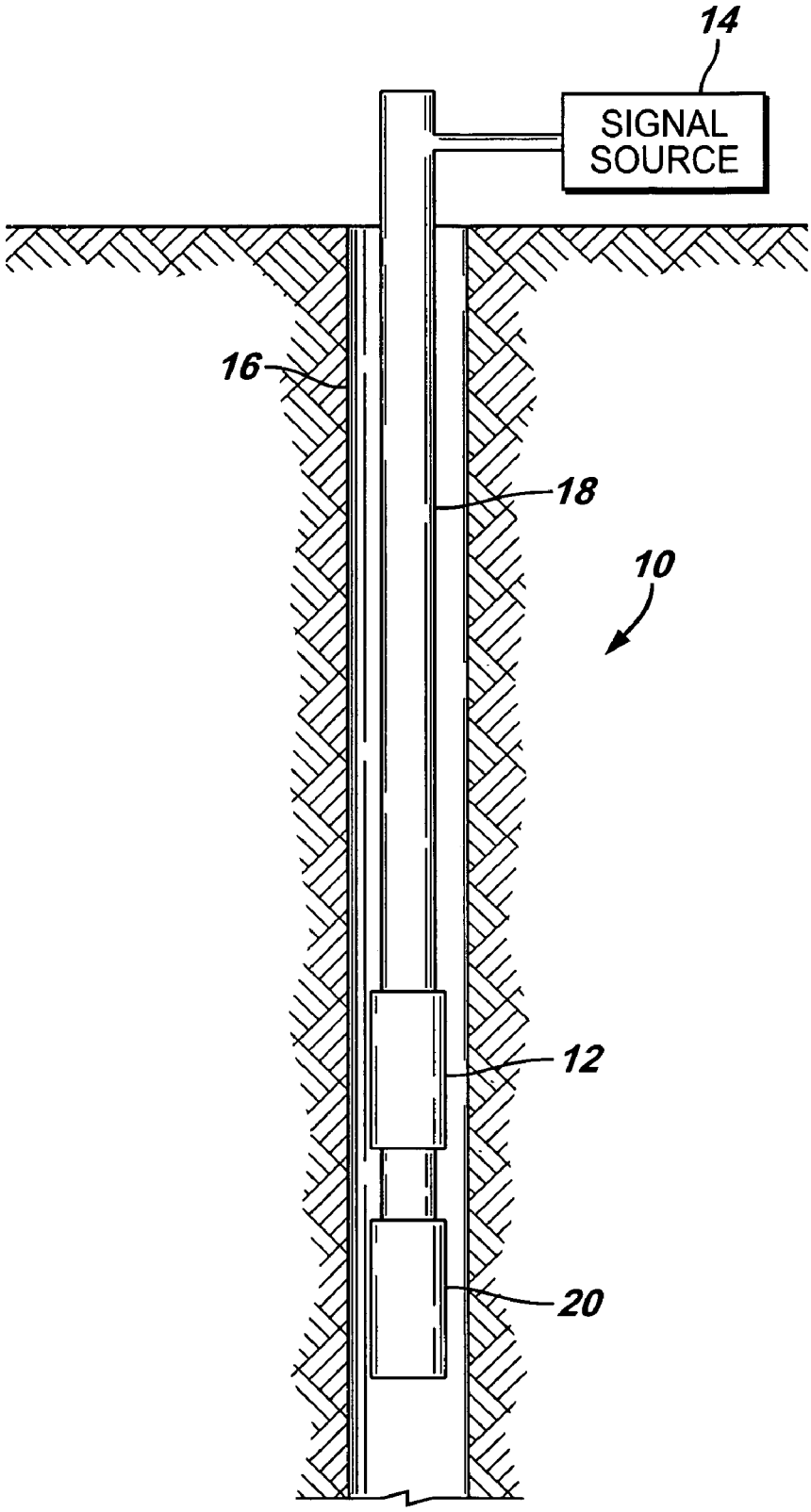
FIG. 1 is a schematic view of a downhole tool controller system constructed in accordance with the present invention.

Referring to FIG. 1, a downhole tool controller system 10 comprises a controller 12 and a signal source 14. Signal source 14 is shown located at or near the surface, but may be placed in any convenient location in or around a well 16. In the embodiment shown, controller 12 is conveyed into well 16 by a tubing 18. The downhole portion of downhole tool controller system 10 may be conveyed by other means such as a wireline or coiled tubing. A downhole tool 20 is shown proximately located to controller 12, but may be variously located in well 16.

Signal source 14 is a device to create signals in well 16 that controller 12 can detect. Signal source 14 may be, without limitation, rig pumps used to create pressure sequences by pressuring a closed volume or by changing the flow rate of fluid past the top of well 16; an air compressor, bottles of compressed gas, or liquid nitrogen pumping units for gas injection and release from well 16; a valve or set of valves that allow well 16 to alternately flow and be shut-in for certain desired periods; or simply the mechanical manipulation of the conveyance device on which downhole controller system 10 is mounted to vary, for example, the hydrostatic pressure on controller 12.

The signal sources listed are examples of devices that create pressure sequences. Pressure sequence devices are preferable, but the invention is not limited to those. For example, the invention also includes the use of acceleration, flow rate, weight, or stress/strain as control parameters. Signal source 14 can vary to produce those or other signal types.

Figure 2:
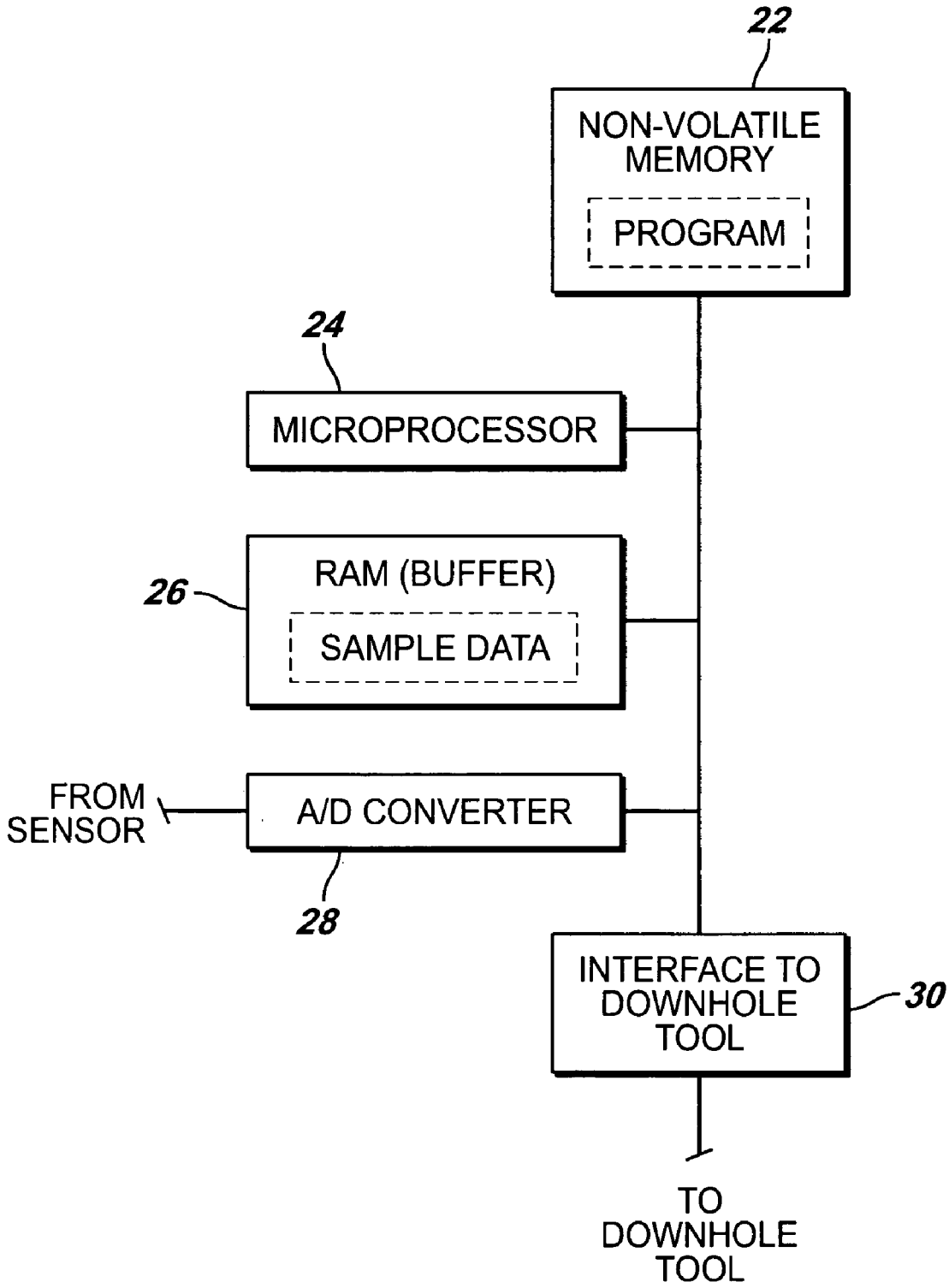
FIG. 2 is a block diagram showing the primary components of the controller of the downhole tool controller system of FIG. 1.

Controller 12 (FIG. 2) comprises nonvolatile memory 22, a microprocessor 24, a buffer 26, an analog-to-digital (A/D) converter 28, and a downhole tool interface 30. Those elements of controller 12 may be separate circuit elements or they may be combined in whole or in part in an integrated circuit.

Programmed instructions and reference parameters or criteria are stored in nonvolatile memory 22. Microprocessor 24 executes those programmed instructions and performs the necessary computation of parameters for comparison to corresponding reference parameters. Microprocessor 24 controls the timing of samples taken and storage of such sampled data in buffer 26.

Buffer 26 is random access memory (RAM) comprising various registers in which data values are sequentially stored. Buffer 26 may initially be set to zero and the registers filled one sample at a time. Each time a new sample is taken, the data stored in buffer 26 is shifted "upward" one register and the new data value is placed in the first or lowermost register. As the buffer receives a data sample, the "oldest" sample, which is stored in the last or highest most register, is allowed to "roll off" the buffer and the most recent data sample is stored in the first register. As explained below, buffer 26 is treated as though it has two halves, though it is preferably a single memory device.

A/D converter 28 takes an analog signal from a sensor and converts the analog signal to a digital signal, as is well known in the art. For example, the sensor may be a pressure transducer that outputs an analog electrical signal in accordance with the sensed pressure. Converter 28 samples the analog signal and provides the digital sample to buffer 26. Other types of sensors may be used.

Downhole tool interface 30 is a device to perform some action that will initiate the actuation of downhole tool 20. Interface 30 awaits a command from microprocessor 24 before performing such action. Interface 30 may be, without limitation, a solenoid, a valve, a frangible element, a pyrotechnic, or a battery, depending on the requirements of downhole tool 20.

In operation, downhole controller system 10 is run into well 16 to some desired depth. System 10 is preferably run in on conventional tubing, but in some embodiments it may be run in using coiled tubing or slickline. For example, coiled tubing may be the conveyance mechanism of choice if flow rate is the key control parameter, i.e., the signal. The rate at which fluid is delivered (volume of fluid per unit time) through the coiled tubing could be sensed by a spinner, a differential pressure gauge, or other means.

Similarly, system 10 may be deployed on a slickline. This may be preferable in the case in which acceleration is used as the control signal. The slickline could be jerked sharply in a pre-determined manner to induce accelerations that are sensed by an accelerometer or other device.

Figure 3:
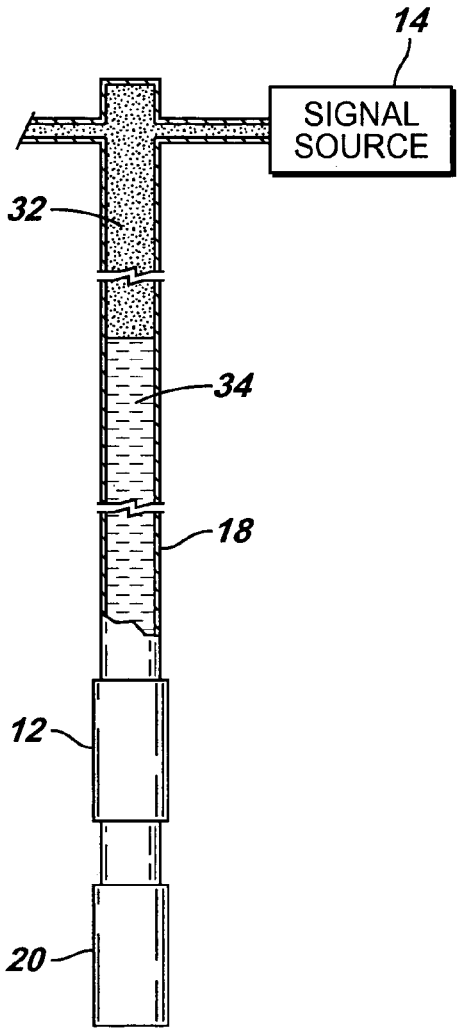
FIG. 3 is a schematic view of an embodiment of the downhole tool controller system of FIG. 1 in which the signal source is a gas.

Returning to the embodiment in which conventional tubing conveys system 10 to the desired depth, FIG. 3 shows an embodiment in which signal source 14 uses a gas to induce pressure pulses. Signal source 14 inputs a pressure signal into a gas layer 32. That signal is typically, though not necessarily, transferred into a liquid layer 34, where it is ultimately sensed by controller 12.

Figure 4:
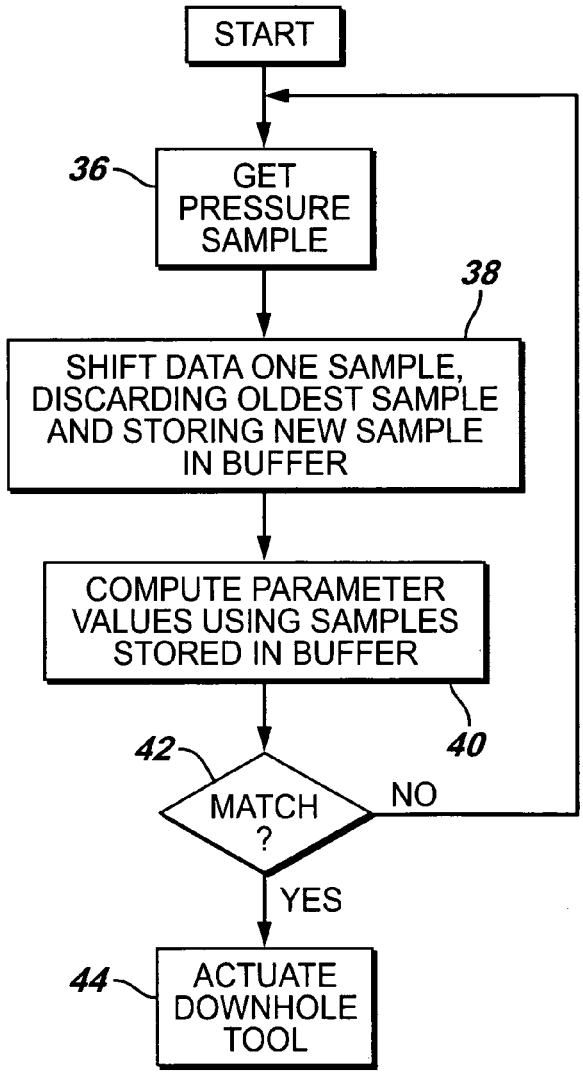
FIG. 4 is a flowchart showing an operational sequence of the controller of the downhole tool controller system of FIG. 1.

Controller 12 operates generally by performing the steps shown in FIG. 4. Controller 12 begins its cycle by obtaining a pressure sample (element 36). Controller 12 shifts the data in buffer 26 "upward" in each register, discarding the data value in the last register and storing the newest data sample in the first register (element 38). Controller 12 computes parameter values using the data in buffer 26. For certain parameters, the first half of buffer 26 and the second half of buffer 26 are used separately (element 40). The two halves of buffer 26 may be used separately because the first half is used to define a command signal, and the second half is used to determine whether a command has been sent. For other parameters, the data in buffer 26 is used as a composite whole. The computed parameters are compared to reference values in various ways, depending on the particular parameter, to determine whether a match occurs (element 42). A "match" means the computed parameters are within predefined tolerances. If no match is found, the cycle is repeated. If a match is found, a command is sent to downhole tool interface 30 to actuate downhole tool 20 (element 44).

Different parameters can be used to decide whether a match has occurred. One such parameter is the normalized correlation coefficient between the two halves. Autocorrelation is a well known technique used in digital signal processing. It involves the comparison of a waveform against itself as one of the waveforms is shifted relative to the other. When the compared curves show no appreciable similarity, the normalized correlation coefficient will be nearly equal to zero. When the compared curves essentially align, the normalized correlation coefficient will be nearly equal to one. In the following description, the temm-"correlation coefficient" shall mean normalized correlation coefficient unless stated otherwise.

Figure 5:
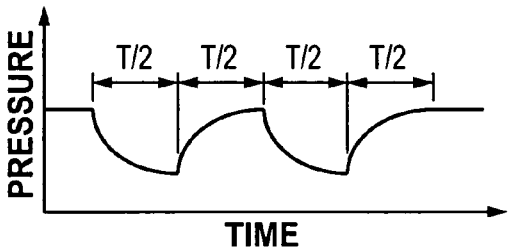
FIG. 5 is a graph of an example signal recorded by the controller of the downhole tool controller system of FIG. 1.

To further explain using an example, suppose buffer 26 has thirty-six registers, each register being able to store a data sample. Registers nineteen through thirty-six make up the first or upper half of buffer 26 and registers one through eighteen make up the second or lower half of buffer 26. Assume signal source 14 is a valve either allowing or preventing the flow of fluids from the well to the surface. Further assume the valve is changed from a closed state to an open state so that the fluid in well 16, initially at static equilibrium, is allowed to flow freely for some half-period T/2. During that half-period, registers one through nine store the sensed pressure at equal time intervals (according to some desired sample rate). A continuous plot showing the recorded waveform over the first half-period T/2 is shown in FIG. 5. The pressure falls as the fluid flows, approaching dynamic equilibrium.

Further assume well 16 is shut in at the end of the first half-period, causing the fluid flow to cease. Assume the shut-in period is for a half-period T/2. As shown in FIG. 5, pressure builds back toward static equilibrium. After a full period T, registers one through nine will contain the waveform from the second half-period and registers ten through eighteen will contain the waveform from the first half-period. Each time before a new sample is taken, the waveform stored in registers one through eighteen is compared to the waveform stored in registers nineteen through thirty-six using a correlation coefficient.

The correlation coefficient is computed by first computing the mean or average of the curve for each full period. The mean for samples one through eighteen is computed by summing those sample values and dividing by eighteen. The mean for the upper half of buffer 26 is computed similarly. The next step in computing the correlation coefficient is to compute the difference between each sample value and the mean for that half of buffer 26. For example, the mean of the lower half of buffer 26 is subtracted from the sample value in register one, the mean of the lower half of buffer 26 is subtracted from the sample value in register two, and so on until the first eighteen differences are computed. The differences between the mean of the upper half of buffer 26 and registers nineteen through thirty-six are similarly calculated.

The differences of corresponding registers are then multiplied as pairs of factors. That is, the difference for register one is multiplied by the difference for register 19. The difference for register two is multiplied by the difference for register 20, and so on until a product is formed for each pair of difference for corresponding registers. Those products are then summed to produce a numerator. To achieve the normalization, that numerator must be divided by a normalization factor.

To compute the normalization factor, one uses the differences computed above. Each difference for the lower half of buffer 26 is squared and those squares are summed. Similarly, each difference for the upper half of buffer 26 is squared and those squares are summed. Those two sums are multiplied together and the square root of that product is taken. The resulting (positive) root is the normalization factor. Dividing the numerator computed above by the normalization factor yields the correlation coefficient.

Expressed as an equation, the correlation coefficient can be written as:

$$\frac{\sum_i (x_i - \bar{x})(y_i - \bar{y})}{\sqrt{\sum_i (x_i - \bar{x})^2 \sum_i (y_i - \bar{y})^2}}$$

where: $x_i$ is a sample in the lower half of buffer 26;

$\bar{x}$ is the mean of the lower half of buffer 26;

$y_i$ is a sample in the upper half of buffer 26; and $\bar{y}$ is the mean of the upper half of buffer 26.

Another parameter used to distinguish between noise and a command signal is the mean for each half of buffer 26. The difference of those means is computed and must be within some operator-defined maximum for the received input to be characterized as a command signal. This helps prevent a false characterization based solely on the correlation coefficient. For example, a straight line having a slope of one would yield a correlation coefficient of one, indicating the "curves" in each half of buffer 26 have identical shapes. However, the mean of the lower half of buffer 26 would be considerably less than the mean for the upper half. If the curves held in memory in each half of buffer 26 are truly similar, their means must also be very nearly the same, within some defined margin.

A further parameter used to distinguish a command signal is the standard deviation. The standard deviation indicates the way in which a function is centered around its mean, as is well known in the art. Again, one would expect the standard deviation of each half of buffer 26 to be nearly equal if the curves stored in each half are similar, Thus, their difference should lie within an operator-defined tolerance. Standard deviation can be used in this way to assist in the decision of whether the operator has issued a command. In addition, standard deviation may be used to assure the received signal has sufficient amplitude to be considered a command signal. By requiring the standard deviation to exceed some threshold value, small amplitude noise can be discriminated against.

As an example, though the invention is by no means limited to this case, assume an operator wishes to perforate two zones in sequence in a well already having a perforated first zone. This situation may arise in the re-working of a well, or it may arise when the first zone is perforated using conventional techniques, but those techniques will not work to perforate the other zones because of the communication path created by the first set of perforations. The present invention make it possible to initiate two perforating tools using unique firing commands. To perforate the second zone, a pressure profile may be generated by shutting in the well for, say, ten minutes, then flowing the well for ten minutes. Alternatively, the pressure profile could be generated by changing between two choke settings in ten-minute intervals. The actual shape of the resulting pressure profile representing the present command signal is not important. What matters is that the pressure changes be of sufficient amplitude and occur at the expected ten-minute intervals. If this pressure profile is immediately repeated, the repeated sequence will match the command signal and controller 12 will cause the gun for the second zone to fire.

Similarly, the gun for the third zone can be fired by creating a new pressure profile, say, using 15-minute time intervals for the shut-in and flow intervals. The new pressure profile becomes the new command signal and, if immediately followed by the same pressure sequence, controller 12 will cause the gun for that zone to fire.

In the preceding description, directional terms, such as "upper," "lower," "vertical," "horizontal," etc., may have been used for reasons of convenience to describe an apparatus and its associated components. However, such orientations are not needed to practice the invention, and thus, other orientations are possible in other embodiments of the invention.

Although only a few example embodiments of the present invention are described in detail above, those skilled in the art will readily appreciate that many modifications are possible in the example embodiments without materially departing from the novel teachings and advantages of this invention. Accordingly, all such modifications are intended to be included within the scope of this invention as defined in the following claims. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A controller system for use in a subterranean well comprising:

a controller located in the well; and a signal source capable of putting a command signal into the well;

wherein the controller is responsive to a repeating command signal that is a repeat of a first command signal, the first and repeating command signals previously unknown to the controller, the controller responsive to the repeating command signal by actuating a tool, wherein the controller is configured to distinguish the first command signal from noise based on characteristics of the first command signal.

2. The controller system of claim 1 in which the controller further comprises:

a memory unit;

a microprocessor;

a buffer;

an analog-to-digital converter; and a downhole tool interface.

3. The controller system of claim 1 in which the signal source provides a pressure sequence.

4. The controller system of claim 1 in which the signal source provides an acceleration.

5. The controller system of claim 1 in which the signal source provides variable flow rates of fluid.

6. The controller system of claim 1 in which the signal source provides variations in applied force.

7. The controller system of claim 1 in which the signal source provides variations in stress or strain.

8. The controller system of claim 1 in which the controller uses at least one computed parameter to distinguish the command signal.

9. The controller system of claim 8 in which the controller further comprises a buffer to store data used to create a first profile and a second profile, and in which the at least one computed parameter includes the correlation coefficient between the first profile and the second profile.

10. The controller system of claim 1, wherein the controller autocorrelates a first waveform representing the first command signal with a second waveform representing the repeating command signal.

11. The controller system of claim 1, wherein each of the first and repeating command signal is a pressure profile, and wherein the controller recognizes the pressure profile by detecting a first occurrence of the pressure profile and a repetition of the pressure profile.

12. The controller system of claim 1, wherein the controller distinguishes the first command signal from noise by comparing a characteristic of a first portion of the first command signal to a characteristic of a second, different portion of the first command signal.

13. The controller system of claim 12, wherein the compared characteristics comprise a mean of the first portion and a mean of the second portion.

14. The controller system of claim 12, wherein the compared characteristics comprise a standard deviation of the first portion and a standard deviation of the second portion.

15. A controller for use in a subterranean well comprising:

a memory unit;

a microprocessor;

a buffer;

an analog-to-digital converter; and a downhole tool interface;

in which the microprocessor executes a program stored in the memory unit to detennine whether to initiate the downhole tool interface based on the recognition of a previously unknown command signal, the microprocessor recognizing the command signal in response to detecting that the command signal has been repeated, and the microprocessor detecting that the command signal has been repeated by calculating a correlation coefficient and comparing the correlation coefficient to a reference value, the correlation coefficient calculated based on comparing a first portion of the command signal with a second portion of the command signal.

16. The controller of claim 15 in which the command signal is sampled by the analog-to-digital converter and the samples are stored in the buffer.

17. The controller of claim 16 in which a portion of the samples stored in the buffer represent a first command signal and a portion of the samples in the buffer represent a repetition of the first command signal.

18. The controller of claim 17 in which the recognition is based on a comparison of the samples representing the first command signal to the samples representing the repetition of the first command signal.

19. The controller of claim 15, wherein the microprocessor recognizes the command signal in response to detecting a first occurrence of the command signal and repetition of the command signal.

20. The controller of claim 15, wherein the command signal previously unknown to the microprocessor is a pressure profile, and wherein the microprocessor recognizes the pressure profile by detecting a first occurrence of the pressure profile and a repetition of the pressure profile.

21. A method to determine whether a previously unknown command signal has been issued into a well comprising:

taking data samples at a desired location in the well;

storing the data samples in a buffer;

computing parameters using the data samples in the buffer, wherein the computed parameters comprise a first parameter for data samples in a first portion of the buffer, and a second parameter for data samples in a second, different portion of the buffer;

comparing the first and second parameters; and deciding whether the data samples in the buffer correspond to a command signal based on the comparing.

22. The method of claim 21 in which computing the first and second parameters includes computing at least one of a first mean and second mean, and computing a first standard deviation and second standard deviation.

23. The method of claim 21, wherein taking the data samples comprises:

taking a first sample representing a first occurrence of the command signal; and taking a second sample representing a second occurrence of the command signal.

24. The method of claim 21, wherein the taking, storing, computing, comparing, and deciding acts are performed by a controller, and wherein the command signal was previously unknown to the controller.

25. A method to control a downhole tool in a subterranean well comprising:

placing a controller in a desired location in the well;

sending a repeating signal from a signal source to the controller;

recording samples while the signal is being sent in a buffer in the controller to create upper and lower profiles in the buffer;

comparing the upper profile to the lower profile to determine whether the profiles constitute a match, wherein the match indicates the repeating signal is a command signal, wherein the command signal was previously undefined at the controller; and initiating actuation of the downhole tool if the match is found.

26. The method of claim 25 in which the comparing includes computing a correlation coefficient.

27. The method of claim 25 in which the comparing includes comparing the mean and standard deviation of the upper profile to the mean and standard deviation of the lower profile.

* * * * *